US005318690A

United States Patent [19]

Fletcher et al.

[11] Patent Number: 5,318,690

[45] Date of Patent: Jun. 7, 1994

[54] GASOLINE UPGRADING PROCESS

[75] Inventors: David L. Fletcher, Turnersville; Timothy L. Hilbert, Sewell; Stephen J. McGovern, Mantua, all of N.J.; John E. Sauer, Washington Crossing, Pa.

[73] Assignee: Mobil Oil Corporation, Fairfax, Va.

[21] Appl. No.: 1,681

[22] Filed: Jan. 7, 1993

Related U.S. Application Data

[63] Continuation-in-part of Ser. No. 850,106, Mar. 12, 1992, which is a continuation-in-part of Ser. No. 745,311, Aug. 15, 1991.

[51] Int. Cl.[5] ..... C10G 35/00; C10G 45/00

[52] U.S. Cl. ..... 208/89; 208/88; 208/92; 208/60; 208/211

[58] Field of Search ..... 208/89, 59, 60, 92, 208/211, 212

[56] References Cited

U.S. PATENT DOCUMENTS

| | | | |
|---|---|---|---|
| 3,759,821 | 9/1973 | Brennan et al. | 208/93 |
| 3,767,568 | 10/1973 | Chen | 208/134 |
| 3,957,625 | 5/1976 | Orkin | 208/211 |
| 4,049,542 | 9/1977 | Gibson et al. | 208/213 |
| 4,062,762 | 12/1977 | Howard et al. | 208/211 |
| 4,753,720 | 6/1988 | Morrison | 208/135 |
| 4,827,076 | 5/1989 | Kokayeff et al. | 208/212 |
| 5,143,596 | 9/1992 | Maxwell et al. | 208/89 |

*Primary Examiner*—Helane Myers

*Attorney, Agent, or Firm*—A. J. McKillop; M. D. Keen

[57] ABSTRACT

Low sulfur gasoline is produced from a catalytically cracked, sulfur-containing naphtha by fractionating the naphtha feed into a low boiling fraction in which the majority of the sulfur is present in the form of mercaptans and a high-boiling fraction in which the sulfur is predominantly in non-mercaptan form such as thiophenes. The low boiling fraction is desulfurized by a non-hydrogenatile mercaptan extraction process which retains the olefins present in this fraction. The second fraction is desulfurized by hydrodesulfurization, which results in some saturation of olefins and loss of octane. The octane loss is restored by treatment over an acidic catalyst, preferably an intermediate pore size zeolite such as ZSM-5, to form a low sulfur gasoline product with an octane number comparable to that of the feed naphtha but which contains some recombined sulfur in the form or mercaptans which are removed in a final hydrotreatment.

23 Claims, 1 Drawing Sheet

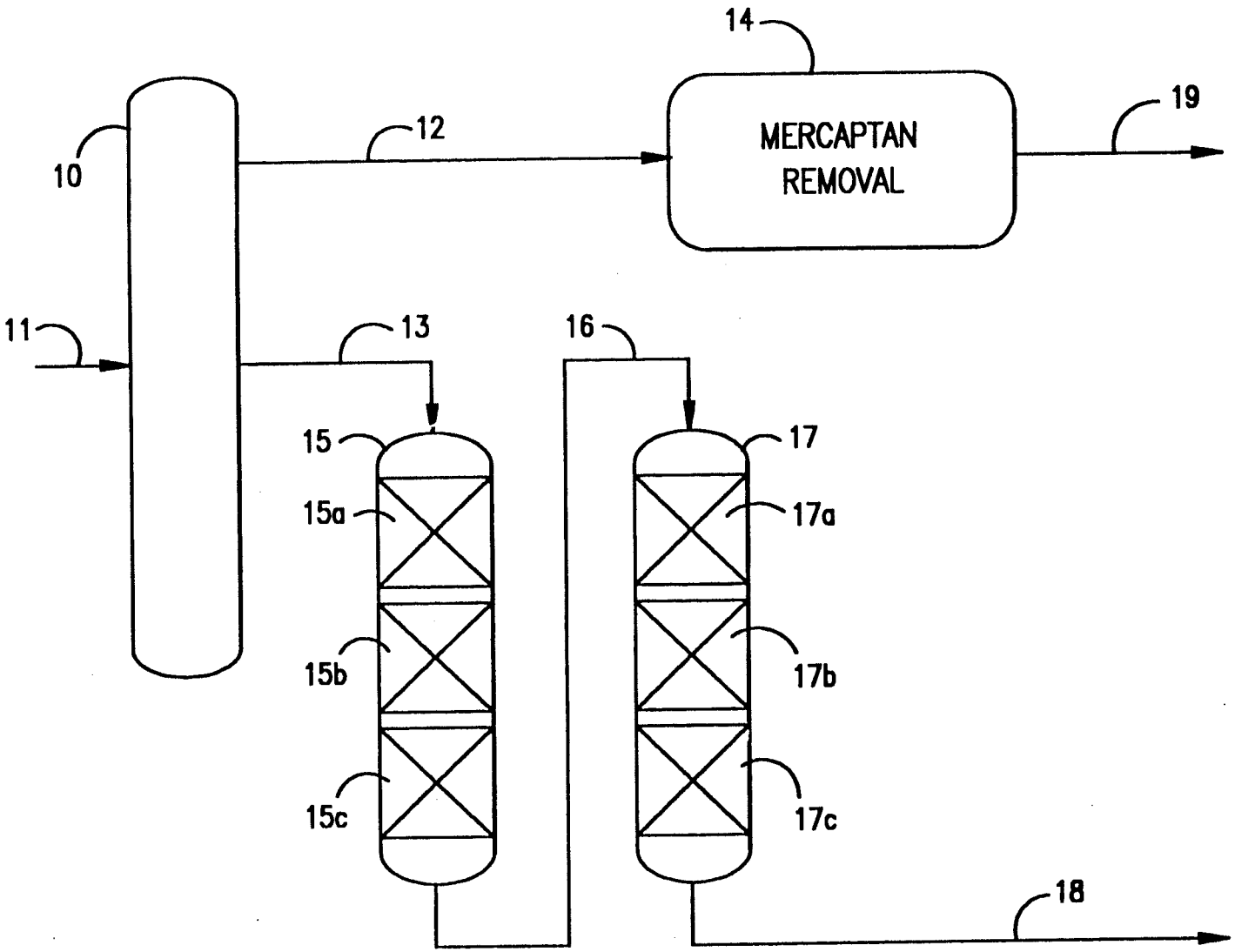
MERCAPTAN
REMOVAL
10
11
12
13
14
15
15a
15b
15c
16
17
17a
17b
17c
18
19

GASOLINE UPGRADING PROCESS

CROSS REFERENCE TO RELATED APPLICATIONS

This application is a continuation-in-part of our prior application Ser. No. 07/850,106, filed 12 March 1992, pending which, in turn, is a continuation-in-part of our prior application Ser. No. 07/745,311, filed 15 August 1991, pending. It is also a continuation-in-part of Ser. No. 07/745,311, pending.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levels result in reduced emissions of CO, $NO_x$ and hydrocarbons.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and - because of current ecological considerations - the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytically reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In our co-pending application Ser. Nos. 07/850,106, filed 12 March 1992, and Ser. No. 07/745,311, filed 15 August 1991, we have described a process for the upgrading of gasoline by sequential hydrotreating and selective cracking steps. In the first step of the process, the naphtha is desulfurized by hydrotreating and during this step some loss of octane results from the saturation of olefins. The octane loss is restored in the second step by a shape-selective cracking, preferably carried out in the presence of an intermediate pore size zeolite such as ZSM-5. The product is a low-sulfur gasoline of good octane rating. Reference is made to Ser. Nos. 07/735,311 and 07/850,106 for a detailed description of this process.

While the olefins in the cracked gasolines are mainly in the front end of these fractions, the sulfur-containing impurities tend to be concentrated in the back end, mainly as thiophenes and other heterocyclic compounds, although front end sulfur is also encountered in the form of mercaptans. The desulfurization takes place readily during the hydrodesulfurization step but is inevitably accompanied by saturation of the olefins; although the resulting loss in product octane is restored in the second step of the process, it would clearly be desirable to reduce the olefin saturation as much as possible so as to retain octane while, at the same time, achieving the desired degree of desulfurization.

SUMMARY OF THE INVENTION

We have now devised a process scheme which enables the desulfurization to be carried out in a way which reduces the saturation of the olefins. This is done by fractionating the cracked gasoline feed into a lower boiling fraction and a higher boiling fraction. The lower boiling fraction is desulfurized by a non-hydrogenative mercaptan removal (extractive) process. The relatively higher boiling fraction is hydrotreated, after which the lost octane is restored by treatment with a catalyst of acidic functionality which effects a limited degree of cracking, mainly of low-octane components in the hydrotreated fraction. The effluent from this step is then given a final hydrotreatment to remove any mercaptans formed in the octane restoration.

The front end of the cracked feed, which is relatively rich in olefins is spared the saturating effect of the hydrodesulfurization but is nevertheless desulfurized by extraction of the mercaptans. The back end, by contrast, is relatively olefin-poor but high in sulfur compounds such as thiophenes and substituted thiophenes which are not amenable to extraction by conventional extractive processes. This higher-boiling, sulfur-rich fraction is effectively desulfurized in the combined treating steps through which it passes. The sulfur from thiophenes, substituted thiophenes and other higher boiling sulfur compounds initially present in the higher boiling fraction, is initially converted to inorganic form during the hydrotreating but undergoes recombination reactions with the olefins formed in the octane restoration step to form mercaptans. These mercaptans may be removed in a final hydrotreat.

According to the present invention, therefore, a sulfur-containing cracked petroleum fraction in the gasoline boiling range is fractionated to form two or more fractions of differing boiling range. The lower boiling fraction is desulfurized by means of a mercaptan extraction process while the higher boiling fraction is hydrotreated to produce a first intermediate product containing a lower proportion of combined organic sulfur. This desulfurized intermediate product, which has undergone a loss in octane by saturation of olefins, is then treated in a second stage, by contact with a catalyst of acidic functionality under conditions which produce a second intermediate product in the gasoline boiling range which is of higher octane value than the first intermediate product. This second intermediate product contains combined organic sulfur in the form of mercaptans which are removed in a final hydrotreat.

BRIEF DESCRIPTION OF THE DRAWING

In the accompanying drawings the single figure is a simplified process schematic for the present process.

DETAILED DESCRIPTION

Feed

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., although higher end points, for example, up to about 500° F. may also be encountered. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.). Because the present process is designed to desulfurize the cracked feed in a way which effectively removes the sulfur across the entire boiling range while retaining olefins, the process will utilize the entire gasoline fraction obtained from the catalytic cracking step. The boiling range of the gasoline fraction will, of course, depend on refinery and market constraints but generally will be within the limits set out above.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the initial combined desulfurization steps will be olefinic, with an olefin content of at least 5 and more typically in the range of 10 to 20, e.g. 15-20, weight percent.

The front end of the cracked fraction contains relatively few sulfur components which are present mainly in the form of mercaptans while the sulfur in the back end is present predominantly in non-mercaptan form, mainly as thiophenes, substituted thiophenes and other heterocyclic compounds which are usually resistant to removal by the extractive processes which are successful with mercaptans; they are, however, subject to removal by hydrotreatment, usually under relatively mild conditions. To this end, the cracked feed is split into a relatively lower boiling fraction which is relatively rich is olefins and contains sulfur mainly in the form of mercaptans and a relatively higher boiling fraction which is relatively poor in olefins but contains rather more sulfur, mainly in the form of sulfur-containing heterocyclic compounds, principally thiophenes and substituted thiophenes.

The cut point between the two fractions may vary to optimize the process and the exact numerical value of the cut point will vary according to the sulfur distribution, type of sulfur compounds present, olefin content and distribution, as well as the final product specifications which have to be met. Normally, the cut point should be selected to keep the sulfur compounds which cannot be readily removed by extraction in the higher boiling fraction so that they may be removed by hydrodesulfurization but some of the mercaptans may be included in the higher boiling fraction as well since they may be removed under mild hydrotreatment conditions, although this may result in a loss of the high octane olefins from the front end of the feed. Higher cut points will be preferred in order to minimize the amount of feed which is passed to the hydrotreater. Usually, the cut point will be in the range from about 100° to 230° F. (about 38° to 110° C.) and in most cases will be in the range from about 140° to 180° F. (about 60° to 82° C.), since the sulfur which is present in components boiling below about 150° F. (about 65° C.) is mostly in the form of mercaptans which may be removed by non-hydrogenative extractive processes, for example, the extractive Merox process. The sulfur compounds in the higher boiling fractions, specifically the thiophenes and substituted thiophenes, are not, however, amenable to removal by these conventional sweetening processes although they may be removed by hydrogenative processing. A cut point of about 180° F. (about 82° C.) will suffice to put the thiophene in the heavy cut. Higher cut points between the two fractions may, however, be used in order to decrease the magnitude of any yield loss across the second step of the process; a cut point of about 230° F. (about 110° C.) will, for instance, leave thiophene in the light cut but give a better yield across the second step and reduce capital cost by reducing the size of the reactor volume required for the second step.

PROCESS CONFIGURATION

The selected sulfur-containing, gasoline boiling range feed is first split into two or more fractions before being subjected to the two differing desulfurization treatments, one hydrogenative and the other non-hydrogenative. The hydrogenative desulfurization treatment results in a saturation of the high octane value olefins present in the higher boiling fraction but this loss is wholly or partially restored in the subsequent shape-selective cracking step. This shape-selective cracking step restores the lost octane but olefins formed at this time tend to undergo recombination with the inorganic sulfur released during the hydrotreating to form mercaptans. The product from the octane restoration step may therefore fail the doctor sweet test as a result of these recombination reactions. The mercaptans may, however, be readily removed by a final hydrotreat carried out under relatively low severity conditions.

The figure provides a simplified process schematic. The cracked material from the FCCU enters a fractionator 10 through inlet 11 and is separated into a number of fractions according to the refinery requirements, including a low boiling cracked gasoline fraction which is withdrawn through line 12 and a higher boiling cracked gasoline fraction which is withdrawn through line 13. The lower boiling gasoline fraction, containing sulfur mainly in the form of mercaptans, is passed through line 12 to an extraction unit 14 in which the mercaptans are removed by a non-hydrogenative technique. The higher boiling fraction is passed to hydrotreater 15 through line 13 and is desulfurized in hydrotreater 15 in catalyst beds **15*a*, 15*b* and 15*c*** the presence of hydrogen, in the conventional manner. The actual number of beds used in practice will be determined by the exotherm of the feed.

The effluent from hydrotreater 15, containing the sulfur from the higher boiling fraction in inorganic form (hydrogen sulfide) is passed through line 16 to enter the second stage reactor 17 in which the desulfurized fractions are subjected in catalyst beds **17*a* and 17*b* to a controlled and limited degree of shape-selective cracking to restore the octane loss which takes place in the hydrotreater as a result of olefin saturation. The higher octane product, which now contains some mercaptans formed by $H_2S$/olefin recombination reactions, then passes through a final bed 17*c* of hydrotreating catalyst, e.g. CoMo on alumina, after which it is withdrawn through line 18 for blending into the refinery gasoline pool together with the extracted light fraction from line 19** and other gasoline components such as straight-run naphtha, alkylate and reformate.

MERCAPTAN REMOVAL

The lower boiling fraction of the gasoline is subjected to a non-hydrogenative desulfurization in a process which removes the mercaptan sulfur compounds. A number of mercaptan removal processes are known and well-established in the petroleum refining industry. Extraction processes using an extractant such as caustic or sodium or potassium cresylate may be used for treating the low boiling cracked fraction, and low product sulfur levels may usually be attained with this fraction by extraction alone since it contains no high molecular weight mercaptans. Extraction with potassium cresylate has been used extensively in many refineries; this process uses a caustic prewash coupled with extraction in a column, usually a rotating disc contactor column, followed by an electrostatic precipitator for final cleanup. The solution may be regenerated by contact with air in a turbo- aerator followed by a separator for air disengagement. The Merox extraction process is suitable for this purpose. In this process the sour feed is contacted with a caustic solution containing the Merox catalyst (an iron-group chelate catalyst - a cobalt phthalocyanine) to extract the mercaptans. The caustic is then regenerated with air to convert the extracted mercaptide sulfur to disulfides which are removed in a separator.

The Merox oxidation/extraction process may also be used for the removal of the mercaptan sulfur. In this version of the Merox process, mercaptans are removed by oxidation in the presence of air and caustic soda for extraction in the presence of the Merox catalyst. The mercaptans are converted to disulfides which are less objectionable than the mercaptans but they may be removed by extraction to reach a low total sulfur level in the final product.

Non-hydrogeantive desulfurization processes of this type are described in Modern Petroleum Technology, G. D. Hobson (Ed.), Applied Science Publishers Ltd., 1973, ISBN 085334 487 6, as well as in Petroleum Processing Handbook, Bland and Davidson (Ed.), McGraw-Hill, New York 1967, pages 3-125 to 3-130. Reference is made to these works for a description of mercaptan removal processes which may be used in the present process for extracting the mercaptan components from the lower boiling fraction.

HYDRODESULFURIZATION

The hydrodesulfurization of the higher boiling fraction of the cracked product is carried out in the conventional manner with a hydrotreating catalyst under conditions which result in the separation of at least some of the sulfur from the feed molecules and its conversion to hydrogen sulfide, to produce a hydrotreated intermediate product comprising a normally liquid fraction boiling in substantially the same boiling range as the feed to this step but with a lower combined (organic) sulfur content and a lower octane number as a consequence of the olefin saturation which takes place.

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. These temperatures are average bed temperatures and will, of course, vary according to the feed and other reaction paramenters including, for example, hydrogen pressure and catalyst activity.

The conditions in the hydrotreating reactor should be adjusted not only to obtain the desired degree of desulfurization in the higher boiling fraction. When operating in cascade mode (no interstage separation or heating) they may also be selected to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are usually desulfurized without undue difficulty, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity for the hydrodesulfurization step overall is typically about 0.5 to 10 LHSV ($hr^{-1}$), preferably about 1 to 6 LHSV ($hr^{-1}$), based on the total feed and the total catalyst volume although the space velocity will vary along the length of the reactor as a result of the stepwise introduction of the feed. The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.), again based on the total feed to hydrogen volumes. The extent of the desulfurization will depend on the sulfur content of the higher boiling fraction and, of course, on the product sulfur specification, with the reaction parameters to be selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the octane restoration step, the operating conditions in the first step may be adjusted accordingly.

The catalyst used in the hydrodesulfurization is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

A change in the volume of gasoline boiling range material typically takes place in the hydrodesulfurization. Although some decrease in volume occurs as the result of the conversion to lower boiling products ($C_5$-) the conversion to $C_5$- products is typically not more than 5 vol percent and usually below 3 vol percent and is normally compensated for by the increase which takes place as a result of aromatics saturation. An increase in volume is typical for the octane restoration step where, as the result of cracking the back end of the hydrotreated feed, cracking products within the gasoline boiling range are produced. An overall increase in volume of the gasoline boiling range ($C_5$+) materials may occur. The process should normally be operated under a combination of conditions such that the desulfurization should be at least about 50 %, preferably at least about 75 %, as compared to the sulfur content of the feed.

It is possible to take a selected fraction of the hydrotreated, desulfurized intermediate product and pass it to alternative processing. A process configuration with potential advantages, for example, is to take a lower boiling cut, such as a 195°-302° F. (90°-150° C.) fraction, from the hydrodesulfurized effluent and send it to the reformer where the low octane naphthenes which make up a significant portion of this fraction are converted to high octane aromatics. The heavy portion of the hydrodesulfurized effluent is, however, sent to the octane restoration step to create new olefins by the controlled shape-selective cracking which takes place in this step of the process. The hydrotreatment in the first stage is effective to desulfurize and denitrogenate the catalytically cracked naphtha which permits this light cut to be processed in the reformer.

OCTANE RESTORATION

After the hydrotreating step, the desulfurized fraction from the hydrodesulfurization unit is passed to the second vapor phase step of the process in which cracking takes place in the presence of the acidic functioning catalyst to restore the octane lost in the hydrodesulfurization of the higher boiling fraction. In this step, the hydrotreated intermediate product is treated by contact with an acidic catalyst under conditions which produce a second intermediate product which boils in the gasoline boiling range and which has a higher octane number than the first (hydrotreated) intermediate product.

The conditions used in the second step of the process are those which result in a controlled degree of shape-selective cracking of the desulfurized, effluents from the deslfurization steps. This controlled cracking restores the octane rating of the original, cracked feed at least to a partial degree. The reactions which take place during this step are mainly the shape-selective cracking of low octane paraffins to form higher octane products, both by the selective cracking of heavy paraffins to lighter paraffins and the cracking of low octane n-paraffins, in both cases with the generation of olefins. Some isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating-×volume) of the final, desulfurized product may exceed the octane barrels of the feed.

The conditions used in the second step are those which are appropriate to produce this controlled degree of cracking. Typically, the temperature of the second step will be about 300° to 900° F. (about 150° to 480° C.), preferably about 350° to 800° F. (about 177° C.). As mentioned above, however, a convenient mode of operation is to cascade the hydrotreated effluent into the second reaction zone and this will imply that the outlet temperature from the first step will set the initial temperature for the second zone. The second step of the process is net endothermic and is favored by the exotherm from the hydrogenation step. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts and mercaptan removal. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$-) during the second stage is held to a minimum. However, because the cracking of the heavier portions of the feed may lead to the production of products still within the gasoline range, no net conversion to $C_5$-products may take place and, in fact, a net increase in $C_5$+ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose are the intermediate pore size zeolitic behaving catalytic materials are exemplified by those acid acting materials having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22. Zeolite MCM-22 is described in U.S. Pat. Nos. 4,962,256 and 4,954,325 to which reference is made for a description of this zeolite and its preparation and properties. Other catalytic materials having the appropriate acidic functionality may, however, be employed. A particular class of catalytic materials which may be used are, for example, the large pores size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. Other metallosilicates such as borosilicates and silicates with other trivalent metals such as iron and gallium may also be used. The zeolite designations referred to above, for example, define the topology only and do not restrict the compositions of the zeolitic-behaving catalytic components.

The catalyst should have sufficient acid activity to have cracking activity with respect to the second stage feed (the intermediate fraction), that is sufficient to convert the appropriate portion of this material as feed. One measure of the acid activity of a catalyst is its alpha number, as discussed in application Ser. Nos. 07/745,311 and 07/850,106, to which reference is made for a description of the alpha characterization. The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material . Examples of these materials are well known and typically include silica, silica-alumina, silica-zirconia, silica-titania, alumina.

The catalyst used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable because it may tend to promote saturation of olefinics produced in the cracking reactions as well as possibly bringing about recombination of inorganic sulfur. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the second conversion catalyst will usually be determined by the type of conversion process which is being carried out and will normally be operated as a a down-flow, liquid or mixed phase, fixed bed process or as an an up-flow, fixed bed, liquid or mixed phase process.

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

Further increases in the volumetric yield of the gasoline boiling range fraction of the product, and possibly also of the octane number (particularly the motor octane number), may be obtained by using $C_3$–$C_4$ cracking products from the octane restoration step as feed for an alkylation process to produce alkylate of high octane number. The light ends from this step are particularly suitable for this purpose since they are olefinic as a result of the cracking which takes place at this time. Alternatively, the olefinic light ends from the octane restoration step may be used as feed to an etherification process to produce ethers such as MTBE or TAME for use as oxygenate fuel components. Depending on the composition of the light ends, especially the paraffin-/olefin ratio, alkylation may be carried out with additional alkylation feed, suitably with isobutane which has been made in this or a catalytic cracking process or which is imported from other operations, to convert at least some and preferably a substantial proportion, to high octane alkylate in the gasoline boiling range, to increase both the octane and the volumetric yield of the total gasoline product.

In one example of the operation of this process, it is reasonable to expect that, with a heavy cracked naphtha feed, the first stage hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5% and, if the sulfur content is high in the feed, that this octane reduction could go as high as about 15%.

The second stage of the process should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate.

The olefins produced by the shape-selective cracking reactions in the second step of the process tend to undergo recombination with the hydrogen sulfide produced in the preceding hydrotreating step if the inorganic sulfur is not removed in an interstage separation. These recombination reactions produce mercaptan sulfur compounds according to the equation:

$$R{-}CH{=}CH_2 + H_2S \longrightarrow R{-}\underset{\underset{SH}{|}}{CH}{-}CH_2$$

These mercaptan compounds may be present in sufficient amounts for the final gasoline product to fail the doctor sweet test but they may be readily removed by a final hydrotreat carried out with a conventional hydrotreating catalyst as described above.

The amount of mercaptan sulfur produced by the recombination. reactions will depend, of course, not only on the amount of sulfur initially present in the higher boiling fraction but also on the degree of cracking and olefin generation which is encountered in the octane-restoration step.

The final hydrotreat may be carried out by cascading the effluent from the second step directly to a bed of the hydrotreating catalyst at the bottom of the reactor vessel. Since the degree of desulfurization required at this point is not great, the bed need not be very deep. The temperature of the stream leaving the octane restoration step will generally be sufficient for the final hydrotreatment, so that direct cascade operation is facilitated. Suitable catalysts for this stage of the process are those used in the first hydrotreating step: hydrotreating catalysts such as NiMo, NiW on porous supports such as alumina or silica-alumina or other conventional hydrotreating catalysts may be used. A preferred catalyst for this step of the process is CoMo on a support such as alumina.

EXAMPLE 1

The following Example illustrates the process, where a 65°-455° F. (18°-235° C.) catalytically cracked naphtha is treated to give a substantially desulfurized product with minimal octane loss.

The sulfur compounds in this cracked naphtha are predominantly thiophenes and light mercaptans due to the nature of the cracking process. The cracked naphtha also contains a high concentration of olefins, which contribute substantially to the octane. The high olefin concentration is reflected in the high bromine number. The properties of this naphtha are shown in Table 1 below.

TABLE 1

| | FCC Naphtha Properties | | |
|---|---|---|---|
| | Full Range | Light Fraction | Heavy Fraction |
| Boiling Range, °F. | 65-455 | 65-285 | 285-455 |
| Fraction of Full Range FCC Naphtha | | | |
| (wt %) | 100 | 71.0 | 29.0 |
| (vol %) | 100 | 73.8 | 26.2 |
| API Gravity | 55.1 | 62.5 | 37.0 |
| Mercaptan Sulfur $C_2$-$C_5$, ppmw | 41 | 58 | 0 |
| Total Sulfur, ppmw | 1240 | 200 | 3800 |
| Bromine Number | 79.15 | 94.89 | 40.62 |
| Nitrogen, ppmw | 19 | 6 | 51 |
| Research Octane | 92.0 | 93.0 | 89.1 |
| Motor Octane | 80.4 | 81.1 | 78.3 |

The naphtha feed was first distilled into a light and heavy fraction. The light fraction (65°-285° F., 18°-140° C.) contains a higher proportion of olefins, as measured by bromine number, and most of the mercaptans present in the feed. The heavy fraction (285°-455° F., 140°-235° C.) contains most of the thiophenic sulfur compounds. The properties of the light and heavy fractions are also shown in Table 1 above.

The heavy fraction was treated in a two stage process to remove sulfur and restore octane. The first hydrodesulfurization stage used a conventional cobalt-molybdenum hydrotreating catalyst, while the second cracking stage restored octane with ZSM-5 catalyst. The properties of the catalysts used in this process are shown in Table 2 below.

TABLE 2

| | Catalyst Properties | |
|---|---|---|
| | Hydrodesulfurization 1st stage Catalyst | ZSM-(1) 2nd stage Catalyst |
| Chemical Composition, wt % | | |
| Nickel | — | |
| Cobalt | 3.4 | — |
| $MoO_3$ | 15.3 | — |
| Physical Properties | | |
| Particle Density, g/cc | — | 0.929 |
| Surface Areas, $m^2/g$ | 260 | 324 |
| Pore Volume, cc/g | 0.55 | 0.699 |
| Pore Diameter, A | 85 | — |

(1)contains 65 wt % ZSM-5 and 35 wt % alumina

Both stages of the process were carried out in an isothermal pilot plant with direct cascade of the first stage effluent to the second stage, without interstage separation of the intermediate products of hydrogen sulfide and ammonia. The ratio of catalyst volumes used in the first and second stages was 1:2 by volume. The pilot plant operated at the following conditions for both stages: 600 psig, space velocity of 0.67 LHSV, a hydrogen circulation rate of 2000 SCF/Bbl (4240 kPa abs, 1 $hr^{-1}$ LHSV, 356 n.l.l.$^{-1}$).

Properties and yields obtained by treating the heavy fraction with the method described above are shown in Table 3 below. The first hydrodesulfurization stage removed the thiophenic sulfur compounds, but a substantial octane loss occurred due to olefin saturation. The second cracking stage restored the octane by selectively cracking low octane paraffins, and generating olefins. Although mercaptans were also formed in the cracking stage from hydrogen sulfide, which is an intermediate product from the first stage, the heavy fraction was substantially desulfurized, with minimal octane loss.

TABLE 3

| Hydrodesulfurization and ZSM-5 Upgrading of Heavy FCC Naphtha Fraction | |
|---|---|
| Stage 1 Temp., °F. (°C.) | 770 (410) |
| Stage 2 Temp., °F. (°C.) | 700 (370) |
| Feed | |
| Boiling Range, °F. (°C.) | 285-455 (140-235) |
| API Gravity | 37.0 |
| Mercaptan Sulfur $C_2$-$C_5$, ppmw | 0 |
| Total Sulfur, ppmw | 3800 |
| Nitrogen, ppmw | 51 |
| Bromine Number | 40.62 |
| Research Octane | 89.1 |
| Motor Octane | 78.3 |
| Wt % $C_5$+ | 100.0 |
| Vol % $C_5$+ | 100.0 |
| Stage 1 Product | |
| Mercaptan Sulfur $C_2$-$C_5$, ppmw | 1 |
| Total Sulfur, ppmw | 3 |
| Nitrogen, ppmw | <1 |
| Bromine Number | 0.51 |
| Research Octane | 75.3 |
| Motor Octane | 68.3 |
| Wt % $C_5$+ | 99.7 |
| Vol % $C_5$+ | 101.5 |
| Vol % $C_3$ Olefins | 0.0 |
| Vol % $C_4$ Olefins | 0.0 |
| Vol % Isobutane | 0.0 |
| Potential Alkylate, Vol %[1] | 0.0 |
| Stage 2 Product | |
| Mercaptan Sulfur $C_2$-$C_5$, ppmw | 91 |
| Total Sulfur, ppmw | 100 |
| Nitrogen, ppmw | <1 |
| Bromine No. | 2.75 |
| Research Octane | 85.5 |
| Motor octane | 77.3 |
| Wt % $C_5$+ | 95.4 |
| Vol % $C_5$+ | 96.8 |
| Vol % $C_3$ Olefins | 0.4 |
| Vol % $C_4$ Olefins | 0.9 |
| Vol % Isobutane | 1.6 |
| Potential Alkylate, vol %[1] | 2.2 |

[1]Potential alkylate defined as 1.7 × ($C_4$ = +$C_3$, vol %

In the present process, this product is then treated to remove the mercaptans formed by recombination reactions. This treatment takes place in a third stage containing a hydrotreating catalyst such as that used in the first stage. Since the mercaptans are easily removed, only about 10 percent by volume of additional hydrotreating catalyst would be required. This may be accomplished most conveniently by loading the additional catalyst in the second stage reactor, beneath and directly in contact with the cracking catalyst. Interstage separation of hydrogen sulfide and ammonia prior to the third stage and a separate vessel for the third stage are not required. The third stage would then operate at the same conditions of the second stage, sufficient to achieve substantial mercaptan removal. Olefins would be saturated in the third stage and some octane loss would be incurred but this would be small as the olefin content of the second stage product is low. An octane loss of 0.7 research octane and 0.4 motor octane would be typical. The third stage hydrotreating step would therefore allow lower mercaptan and total sulfur concentrations to be achieved with a minimum of additional capital expenditure.

The light fraction of the raw FCC naphtha would be treated in an extractive type process for sulfur reduction. The mercaptans in the light fraction are predominantly $C_2$–$C_5$, and are easily removed in conventional processes while preserving the high octane olefins. Assuming little change in the feed composition except the extraction of mercaptans, properties of the treated light cut would be as those set out in Table 4 below. It is less desirable to treat the lighter fraction in a two step hydrodesulfurization/octane restoration sequence since the hydrodesulfurization step would result in a high octane loss from the saturation of olefins which are more abundant in this fraction. Although this loss could be restored in the second cracking step, the $C_5$+ yield would be low since the light paraffins present in this light fraction crack to gas.

TABLE 4

| Treated Naphtha Properties | Mercaptan Extraction of light FCC Naphtha Fraction |
|---|---|
| Boiling Range, °F. (°C.) | 65–285 (18–140) |
| Mercaptan Sulfur $C_2$–$C_5$, ppmw | <5 |
| Total Sulfur, ppmw | <147 |
| Research Octane | 93.0 |
| Motor Octane | 81.1 |

By processing the FCC naphtha in the manner described above, with the heavy fraction treated in the two stage catalytic process for sulfur removal and octane enhancement, with the light fraction being subjected to an extractive process for mercaptan removal, the final treated FCC naphtha would have the properties set out in Table 5 below.

TABLE 5

| Blended Properties of Treated Light and Heavy FCC Naphtha Fractions | |
|---|---|
| Boiling Range, °F. (°C.) | 65–455 (18–235) |
| Yield on Full Range FCC Naphtha | |
| wt % | 98.7 |
| vol % | 99.2 |
| Mercaptan Sulfur $C_2$–$C_5$ | <5 |
| Total Sulfur, ppmw | <110 |
| Research Octane | 90.8 |
| Motor Octane | 80.0 |

As shown by Table 5, the full boiling range raw FCC naphtha is substantially desulfurized with minimal octane and yield loss.

EXAMPLE 2

The same 65°–455° F. (18°–235° C.) catalytically cracked naphtha used in Example 1 was distilled into a light fraction and a heavy fraction as described in Example 1.

The heavy fraction was treated in a three stage process to remove sulfur and restore octane. The first stage was a hydrodesulfurization stage which used the same cobalt-molybdenum hydrotreating catalyst as in Example 1; the second cracking stage restored octane with the same ZSM-5 catalyst as used in Example 1 and the third stage was a hydrodesulfurization stage which used the same CoMo hydrodesulfurization catalyst as the first stage.

All three stages of the process were carried out in an isothermal pilot plant with direct cascade of the first stage effluent to the second stage and from the second stage to the third stage, without interstage separation of the intermediate products of hydrogen sulfide and ammonia. The ratio of catalyst volumes used in the stages was 5:10:1. The pilot plant operated at the following conditions: 600 psig, overall space velocity of 0.62 LHSV (relative to the total catalyst load), and a hydrogen circulation rate of 2000 SCF/Bbl (4240 kPa abs, 0.62 hr LHSV, 356 n.l.l.$^{-1}$).

Properties and yields for the products obtained by treating the heavy fraction with the method described above are shown in Table 6 below (Stage 2 and 3 products only). The first stage product has been substantially desulfurized and has undergone a loss of octane which has been restored in the second stage by the selective cracking of low octane paraffins and the generation of some olefins. Mercaptans are, however, formed in the second stage from the hydrogen sulfide which is an intermediate product from the first stage. The mercaptans were removed in the third stage with a minimal loss in octane

TABLE 6

| Hydrodesulfurization and ZSM-5 Upgrading of Heavy FCC Naphtha Fraction | |
|---|---|
| Stage 1 Temp., °F. (°C.) | 700 (370) |
| Stage 2 Temp., °F. (°C.) | 700 (370) |
| Stage 3 Temp., °F. (°C.) | 700 (370) |
| Feed | |
| Boiling Range, °F. (°C.) | 285–455 (140–235) |
| API Gravity | 37.0 |
| Mercaptan Sulfur $C_2$–$C_5$, ppmw | 0 |
| Total Sulfur, ppmw | 3800 |
| Nitrogen, ppmw | 51 |
| Bromine Number | 40.62 |
| Research Octane | 89.1 |
| Motor Octane | 78.3 |
| Wt % $C_5$+ | 100.0 |
| Vol % $C_5$+ | 100.0 |
| Stage 2 Product | |
| Mercaptan Sulfur $C_2$–$C_5$, ppmw | 52 |
| Total Sulfur, ppmw | 61 |
| Nitrogen, ppmw | <1 |
| Research Octane | 86.3 |
| Motor octane | 78.3 |
| Wt % $C_5$+ | 94.0 |
| Vol % $C_5$+ | 95.2 |
| Vol % $C_3$ Olefins | 0.3 |
| Vol % $C_4$ Olefins | 0.7 |
| Vol % Isobutane | 2.6 |
| Potential Alkylate, vol %[1] | 1.8 |
| Stage 3 Product | |
| Mercaptan Sulfur $C_2$–$C_5$, ppmw | 2.6 |
| Total Sulfur, ppmw | 3.7 |
| Nitrogen, ppmw | <1 |
| Research Octane | 84.8 |
| Motor octane | 77.1 |
| Wt % $C_5$+ | 94.6 |
| Vol % $C_5$+ | 96.0 |
| Vol % $C_3$ Olefins | 0.0 |
| Vol % $C_4$ Olefins | 0.05 |
| Vol % Isobutane | 2.7 |
| Potential Alkylate, vol %[1] | 0.07 |

[1]Potential alkylate defined as 1.7 × ($C_4$ = +$C_3$, vol %

The third stage product may be blended with the extracted light fraction as described above in Example 1, to produce a low sulfur gasoline.

We claim:

1. A process of upgrading a sulfur-containing cracked feed in the gasoline boiling range having a 95 percent point of at least about 325° F. which comprises:

fractionating the feed to form a first fraction and a second fraction which boils above the first fraction, desulfurizing the first fraction by a non-hydrogenative mercaptan removal process to form a first desulfurized product in the gasoline boiling range, hydrodesulfurizing the second fraction in the presence of a hydrodesulfurization catalyst under conditions of elevated temperature, elevated pressure and in an atmosphere comprising hydrogen, to produce a desulfurized first intermediate product;

contacting the desulfurized first intermediate product with a catalyst of acidic functionality to convert it to a second intermediate product comprising a fraction boiling in the gasoline boiling range having a higher octane number than the gasoline boiling range fraction of the desulfurized first intermediate product and containing combined organic sulfur, hydrodesulfurizing the second intermediate product to form a second desulfurized product in the gasoline boiling range.

2. The process as claimed in claim 1 in which said feed fraction comprises a light naphtha fraction having a boiling range within the range of $C_6$ to 330° F.

3. The process as claimed in claim 1 in which said feed fraction comprises a full range naphtha fraction having a boiling range within the range of $C_5$ to 420° F.

4. The process as claimed in claim 1 in which said feed is a catalytically cracked naphtha fraction comprising olefins.

5. The process as claimed in claim 1 in which said feed fraction comprises a naphtha fraction having a 95 percent point of at least about 350° F.

6. The process as claimed in claim 5 in which said feed fraction comprises a naphtha fraction having a 95 percent point of at least about 380° F.

7. The process as claimed in claim 6 in which said feed fraction comprises a naphtha fraction having a 95 percent point of at least about 400° F.

8. The process of claim 1 in which the feed is fractionated into the first fraction which has a boiling range with an end point below 180° F. and the second fraction of higher boiling range.

9. The process of claim 8 in which the feed is fractionated into the first fraction which has a boiling range with an end point below 160° F. and the second fraction of higher boiling range.

10. The process as claimed in claim 1 in which the acidic catalyst comprises an intermediate pore size zeolite in the aluminosilicate form.

11. The process as claimed in claim 1 in which the hydrodesulfurization of the second fraction is carried out at a temperature of about 400 to 800° F, a pressure of about 50 to 1500 psig, a space velocity of about 0.5 to 10 LHSV (based on total hydrocarbon feed), and a hydrogen to hydrocarbon ratio of about 500 to 5000 standard cubic feet of hydrogen per barrel of total feed.

12. The process as claimed in claim 1 in which the second stage upgrading is carried out at a temperature of about 300 to 900° F, a pressure of about 50 to 1500 psig, a space velocity of about 0.5 to 10 LHSV, and a hydrogen to hydrocarbon ratio of about 0 to 5000 standard cubic feet of hydrogen per barrel of feed.

13. The process of claim 1 in which the first fraction is desulfurized by oxidation with air in the presence of a catalyst comprising an iron group chelate.

14. A process of upgrading a catalytically cracked, olefinic, sulfur-containing gasoline feed having a sulfur content of at least 50 ppmw, an olefin content of at least 5 percent and a 95 percent point of at least 325° F, which process comprises:

separating the sulfur-containing feed into (i) a first sulfur-containing fraction which contains olefins and sulfur components in the form of mercaptans and (ii) a second sulfur-containing fraction in which the sulfur components are present predominantly in non-mercaptan form and which boils above the first fraction, desulfurizing the first fraction by removal of the mercaptans without saturation of the olefins present in the first fraction to form a first desulfurized product in the gasoline boiling range, hydrodesulfurizing the second fraction under conditions of elevated temperature, elevated pressure and in an atmosphere comprising hydrogen, to produce a first desulfurized intermediate product comprising a normally liquid fraction which has a reduced sulfur content and a reduced octane number as compared to the second sulfur-containing fraction;

contacting the gasoline boiling range portion of the first desulfurized intermediate product with an acidic zeolite catalyst to form a second intermediate product comprising a fraction boiling in the gasoline boiling range having a higher octane number than the gasoline boiling range fraction of the first desulfurized intermediate product and containing combined organic sulfur in the form of mercaptans, hydrodesulfurizing the second intermediate product to form a second desulfurized product in the gasoline boiling range, combining the first desulfurized product with the second desulfurized product.

15. The process as claimed in claim 14 in which the feed fraction has a 95 percent point of at least 350° F, an olefin content of 10 to 20 weight percent, a sulfur content from 100 to 5,000 ppmw and a nitrogen content of 5 to 250 ppmw.

16. The process as claimed in claim 15 in which said feed fraction comprises a naphtha fraction having a 95 percent point of at least about 380° F.

17. The process of claim 14 in which the feed is fractionated into the first fraction which has a boiling range with an end point below 180° F and the second fraction of higher boiling range.

18. The process of claim 17 in which the first fraction is desulfurized by extraction of the mercaptans with aqueous caustic and oxidation of the mercaptans with air in the presence of a catalyst comprising an iron group chelate.

19. The process as claimed in claim 18 in which the intermediate pore size zeolite has the topology of ZSM-5.

20. The process as claimed in claim 14 in which the acidic catalyst comprises an intermediate pore size zeolite in the aluminosilicate form.

21. The process as claimed in claim 20 in which the intermediate pore size zeolite has the topology of ZSM-5.

22. The process of claim 21 in which the first fraction is desulfurized by oxidation with air in the presence of a catalyst comprising an iron group chelate.

23. The process of claim 22 in which the first fraction is desulfurized by extraction of the mercaptans with aqueous caustic and oxidation of the extracted mercaptans with air in the presence of a catalyst comprising an iron group chelate.

* * * * *